US011046072B2

(12) United States Patent
Hori

(10) Patent No.: US 11,046,072 B2
(45) Date of Patent: Jun. 29, 2021

(54) PRINTING APPARATUS

(71) Applicant: SEIKO EPSON CORPORATION, Tokyo (JP)

(72) Inventor: Naoki Hori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/930,513

(22) Filed: May 13, 2020

(65) Prior Publication Data

US 2020/0361206 A1 Nov. 19, 2020

(30) Foreign Application Priority Data

May 16, 2019 (JP) ..... JP2019-092553

(51) Int. Cl.
*B41J 2/14* (2006.01)
*B41J 29/377* (2006.01)

(52) U.S. Cl.
CPC ..... *B41J 2/14* (2013.01); *B41J 29/377* (2013.01); *B41J 2202/08* (2013.01)

(58) Field of Classification Search
CPC ..... B41J 29/38; B41J 2202/08; B41J 29/02; B41J 29/377; B41J 2/14
See application file for complete search history.

(56) References Cited

U.S. PATENT DOCUMENTS

2011/0109693 A1* 5/2011 Ohnishi ..... B41J 29/02 347/34
2016/0297221 A1 10/2016 Kitazawa et al.
2018/0257410 A1* 9/2018 Profaca ..... B41J 29/377

FOREIGN PATENT DOCUMENTS

JP 2015-058659 A 3/2015
JP 2016-198926 A 12/2016

* cited by examiner

*Primary Examiner* — Jannelle M Lebron
(74) *Attorney, Agent, or Firm* — Workman Nydegger

(57) ABSTRACT

A circuit unit includes a circuit board, a cover being configured to house the circuit board inside, a first airflow inlet formed in a first surface of the cover, and a first duct formed in the first surface wherein the first duct is in communication with the first airflow inlet, and a sliding mechanism that supports the circuit unit such that the circuit unit is movable, the sliding mechanism includes a fixed frame, a second airflow inlet formed in the fixed frame, and a second duct that is formed in the fixed frame and in communication with the second airflow inlet, and, when the circuit unit is located at the first position, the first duct and the second duct are engaged with each other such that a third duct is formed to cause the first airflow inlet and the second airflow inlet communicate each other.

8 Claims, 8 Drawing Sheets

PRINTING APPARATUS

The present application is based on, and claims priority from JP Application Serial Number 2019-092553, filed May 16, 2019, the disclosure of which is hereby incorporated by reference herein in its entirety.

BACKGROUND

1. Technical Field

The invention relates to a printing apparatus that performs printing by ejecting liquid.

2. Related Art

In a printing apparatus that performs printing by ejecting liquid such as ink to a printing medium, mist is generated when the liquid is ejected by a print head, and the mist floats in the apparatus.

JP-A-2016-198926 discloses a configuration in which a wall part is provided between a heat sink that makes contact with a circuit board for driving a print head and a range in which an ejection port and a supply port of air flow are formed in a cover frame that holds the circuit board for the purpose of reducing adhesion of mist included in the airflow to the circuit board (see JP-A-2016-198926).

Other than the configuration with the positional relationship between the circuit board, the heat sink, the supply port, and the like disclosed in the JP-A-2016-198926, a configuration for further improving protection of the circuit board from mist in the printing apparatus is desired. In addition, the circuit board to be protected from the mist is not limited to the circuit board for driving the print head.

SUMMARY

A printing apparatus includes a support unit configured to support a printing medium, a print head disposed at a position opposite the support unit, the print head being configured to eject liquid to the printing medium, a circuit unit disposed downstream of the print head in a transport path of the printing medium at a position opposite the support unit, and a sliding mechanism configured to support the circuit unit such that the circuit unit is movable in a first direction in which the circuit unit approaches the support unit and a second direction that is opposite the first direction, wherein the circuit unit includes a circuit board, a cover surrounding an opposing face is opposite the support unit, the cover being configured to house the circuit board inside the cover, a first airflow inlet formed in a first surface of the cover, and a first duct that is formed in the first surface and in communication with the first airflow inlet, the sliding mechanism includes a fixed frame fixed inside the printing apparatus and configured to support the circuit unit, a second airflow inlet formed in the fixed frame, the second airflow inlet being formed at a position that is opposite the first airflow inlet when the circuit unit is located at a first position where the circuit unit is close to the support unit, and a second duct that is formed in the fixed frame and in communication with the second airflow inlet, and when the circuit unit is located at the first position, the first duct and the second duct are engaged with each other such that a third duct is formed to cause the first airflow inlet and the second airflow inlet communicate with each other.

DESCRIPTION OF EMBODIMENTS

An embodiment of the present disclosure will be described below with reference to the accompanying drawings. The drawings are merely examples for describing the present embodiment. Since the drawings are examples, shapes and ratios may be inaccurate, may contradict with each other, or may be partially omitted.

1. Schematic Configuration of Printing Apparatus

Figure 1:
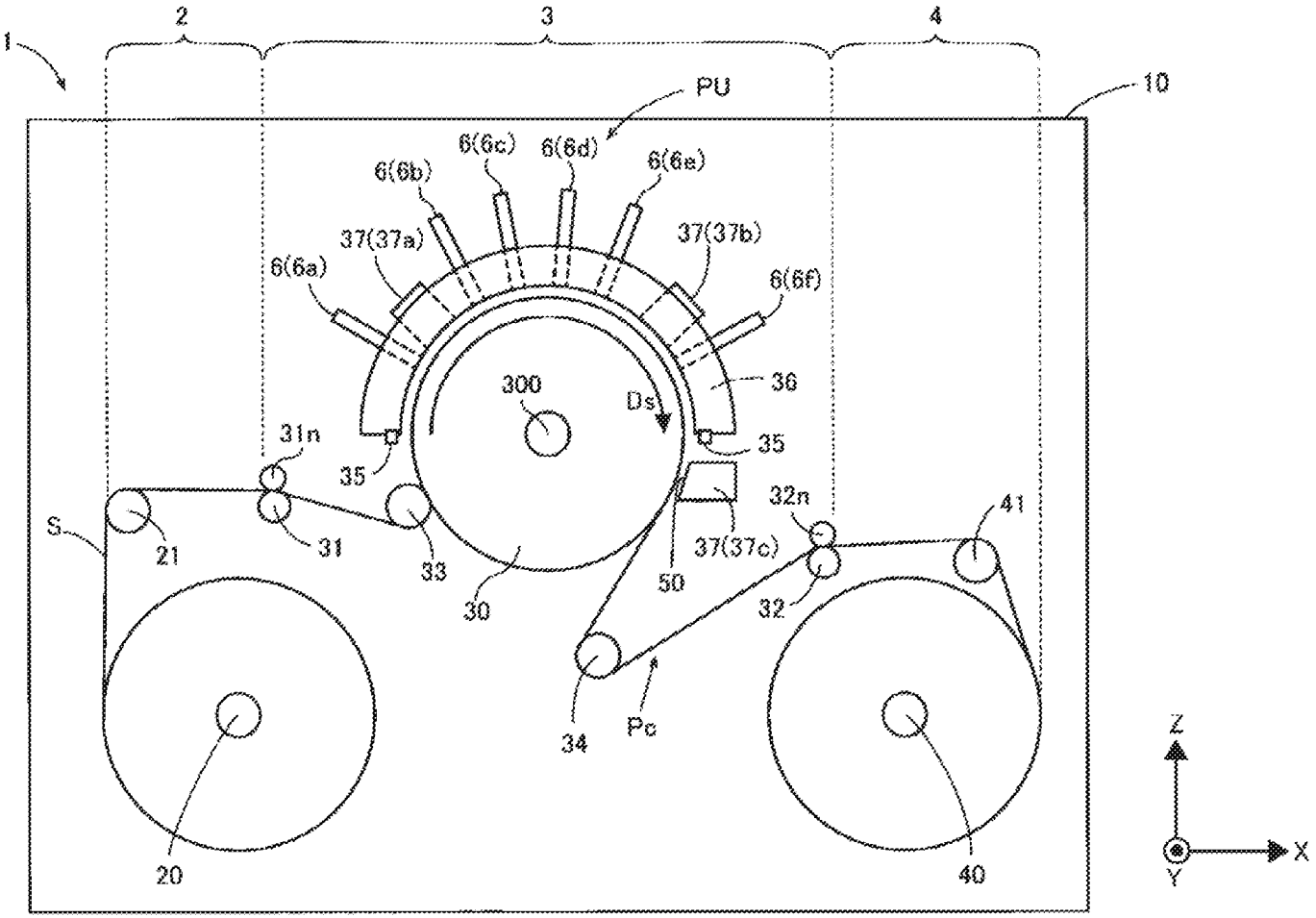
FIG. 1 is a schematic view illustrating a configuration of a printing apparatus.

FIG. 1 is a schematic view illustrating a configuration of a printing apparatus 1. The printing apparatus 1 may be referred to as an ink-jet printer, a liquid ejection apparatus, an image recording apparatus, and the like. In the drawings, an XYZ orthogonal coordinate system with X, Y and Z directions is illustrated for understanding of the arrangement relationship of the parts of the apparatus. In FIG. 1, the direction from left to right is the X direction, the direction from the far side (rear side) to the near side (front side) is the Y direction, and the vertical upward direction is the Z direction. As illustrated in FIG. 1, the printing apparatus 1 includes a feeding shaft 20 and a winding shaft 40, and a single sheet S in a roll shape wound around the feeding shaft 20 and the winding shaft 40 is pulled therebetween along a transport path Pc.

The sheet S is a printing medium. Printing on the sheet S is performed while the sheet S is transported in a transport direction Ds from the feeding shaft 20 toward the winding shaft 40. The transport direction Ds is the direction along the transport path Pc. In the example illustrated in FIG. 1, the transport path Pc is formed in a combination of a plurality of straight lines and curved lines, and accordingly the transport direction Ds differs among positions in the transport path Pc. Types of the sheet S are broadly categorized into a paper type and a film type. Specific examples of the paper type include a high-quality paper, cast paper, art paper and coated paper, and specific examples of the film type include synthetic paper, polyethylene terephthalate (PET) and polypropylene (PP).

The printing apparatus 1 generally includes a feeding unit 2 that feeds the sheet S from the feeding shaft 20, a processing unit 3 that performs printing on the sheet S fed from the feeding unit 2, and a winding unit 4 that winds, around the winding shaft 40, the sheet S on which printing has been performed by the processing unit 3. The feeding unit 2, the processing unit 3, and the winding unit 4 arranged in the X direction are housed in a housing 10 of the printing apparatus 1. In the transport path Pc, the feeding unit 2 is located upstream of the processing unit 3 and the winding unit 4. In addition, in the transport path Pc, the winding unit 4 is located downstream of the feeding unit 2 and the processing unit 3. In the following description, upstream and downstream in the transport path Pc are simply referred to as upstream and downstream.

The feeding unit 2 includes the feeding shaft 20 around which an end of the sheet S is wound, and a driven roller 21 on which the sheet S drawn out from the feeding shaft 20 is wound. When the feeding shaft 20 is rotated clockwise in FIG. 1, the sheet S wound around the feeding shaft 20 is fed to the processing unit 3 through the driven roller 21. While supporting the sheet S fed from the feeding unit 2 by means of the rotary drum 30, the processing unit 3 performs printing an image on the sheet S by appropriately performing a process using a processing unit PU disposed along the outer circumferential surface of the rotary drum 30. In the processing unit 3, a front driving roller 31 and a rear driving roller 32 are provided near both ends of the rotary drum 30 in the X direction. The sheet S transported from the front driving roller 31 to the rear driving roller 32 is supported by the rotary drum 30.

The front driving roller 31 rotates clockwise in FIG. 1 to thereby transport downstream the sheet S fed from the feeding unit 2. A nip roller 31*n* is provided for the front driving roller 31. The nip roller 31*n* makes contact with the sheet S to thereby sandwich the sheet S between the nip roller 31*n* and the front driving roller 31. Thus, a frictional force between the front driving roller 31 and the sheet S is ensured and the sheet S is reliably transported by the front driving roller 31.

The rotary drum 30 is a cylindrical drum having a central axis parallel to the Y direction. In the example of FIG. 1, the rotary drum 30 corresponds to a "support unit" that supports the printing medium. The support unit that supports the printing medium is also referred to as a platen. The rotary drum 30 includes a rotary shaft 300 extending in the axis direction through the central line of the cylindrical shape of the rotary drum 30. The rotary shaft 300 is rotatably supported by a support mechanism (not illustrated), and the rotary drum 30 rotates about the rotary shaft 300. On the outer circumferential surface of the rotary drum 30, the sheet S transported from the front driving roller 31 to the rear driving roller 32 is wound. The rotary drum 30 supports the sheet S while being driven into rotation in the transport direction Ds of the sheet S by receiving a frictional force between the rotary drum 30 and the sheet S.

The processing unit 3 is provided with driven rollers 33 and 34 that fold back the sheet S at both ends of the region of the sheet S that is wound on the rotary drum 30. The driven roller 33 folds back the sheet S by winding the sheet S between the front driving roller 31 and the rotary drum 30. On the other hand, the driven roller 34 folds back the sheet S by winding the sheet S between the rotary drum 30 and the rear driving roller 32. In this manner, by folding back the sheet S at respective positions upstream and downstream of the rotary drum 30, a long range in which the sheet S is wound on the rotary drum 30 can be ensured.

The rear driving roller 32 winds the sheet S that is transported from the rotary drum 30 through the driven roller 34. In addition, the rear driving roller 32 rotates clockwise in FIG. 1 to thereby transport the sheet S to the winding unit 4. A nip roller 32*n* is provided for the rear driving roller 32. The nip roller 32*n* makes contact with the sheet S to thereby sandwich the sheet S between the nip roller 32*n* and the rear driving roller 32. Thus, a frictional force between the rear driving roller 32 and the sheet S is ensured and the sheet S is reliably transported by the rear driving roller 32.

The processing unit PU includes a plurality of print heads 6 and a plurality of UV irradiators 37. Reference signs 6*a*, 6*b*, 6*c*, 6*d*, 6*e* and 6*f* are appropriately used for distinction of the individual print heads 6. Likewise, reference signs 37*a*, 37*b*, and 37*c* are appropriately used for distinction of the individual UV irradiators 37. The processing unit PU also includes a carriage 36. The carriage 36 includes the print heads 6*a*, 6*b*, 6*c*, 6*d*, 6*e* and 6*f* and the UV irradiators 37*a* and 37*b*.

The plurality of print heads 6 and the plurality of UV irradiators 37 are disposed along the outer circumference of the rotary drum 30 in such a manner as to face the outer circumferential surface of the rotary drum 30. In FIG. 1, the print heads 6*a*, 6*b*, 6*c*, 6*d*, 6*e* and 6*f* and the UV irradiators 37*a*, 37*b* and 37*c* are radially disposed with respect to the rotary shaft 300 of the rotary drum 30. For example, the print heads 6*a*, 6*b*, 6*c*, 6*d*, 6*e* and 6*f* correspond to white (W), cyan (C), magenta (L), yellow (Y), black (K), and clear (CL), respectively, and can eject inks of respective colors by an ink-jet method. The print head 6 includes a plurality of nozzles (not illustrated) at opposing faces facing the outer circumferential surface of the rotary drum 30, and ejects the ink in the form of liquid from the nozzles. The print head 6 may be referred to as an ink-jet head, a liquid ejection head, or the like. A color image is printed on the sheet S supported by the rotary drum 30 by ejecting the ink by the print heads 6.

Each print head uses an ultraviolet (UV) ink that is cured when irradiated with an ultraviolet ray. The UV ink is referred also to as a photo-curable ink. The UV irradiator 37 is provided for the purpose of curing and fixing the ink to the sheet S. The UV irradiator 37 applies an ultraviolet ray from the opposing face facing the outer circumferential surface of the rotary drum 30. In the example of FIG. 1, the UV irradiator 37*a* is disposed between the print head 6*a* and the print head 6*b*, and the UV irradiator 37*b* is disposed between the print head 6*e* and the print head 6*f*. Thus, the W ink ejected from the print head 6*a* to the sheet S is cured by receiving an ultraviolet ray from the UV irradiator 37*a* before the C, M, Y, K and CL inks are overlaid. The C, M, Y and K inks ejected from the print heads 6*b*, 6*c*, 6*d* and 6*e* to the sheet S are cured by receiving an ultraviolet ray from the UV irradiator 37*b* before the CL ink is overlaid.

In the example of FIG. 1, a guide rail 35 extending parallel to the Y direction is disposed at a predetermined position on the left and right of the carriage 36, and the carriage 36 is mounted across the two guide rails 35. Thus, the print heads 6*a*, 6*b*, 6*c*, 6*d*, 6*e* and 6*f* and the UV irradiators 37*a* and 37*b* mounted on the carriage 36 can be moved parallel to the Y direction by the carriage 36.

In the processing unit 3, the UV irradiator 37*c* is disposed downstream of the print head 6*f*. Thus, the CL ink ejected from the print head 6*f* to the sheet S is cured by receiving an ultraviolet ray from the UV irradiator 37*c*. The UV irradiator 37*c* is not mounted on the carriage 36. The UV irradiator 37*c* corresponds to a "first irradiator" and the UV irradiators 37*a* and 37*b* different from the UV irradiator 37*c* correspond to a "second irradiator". The UV irradiator 37*c* is an example of a "circuit unit".

The sheet S on which printing has been performed by the processing unit 3 is transported to the winding unit 4 by the rear driving roller 32. The winding unit 4 includes a driven roller 41 that winds the sheet S between the winding shaft 40 and the rear driving roller 32 in addition to the winding shaft 40 around which the end of the sheet S is wound. When the winding shaft 40 rotates clockwise in FIG. 1, the sheet S transported from the rear driving roller 32 is wound around the winding shaft 40 through the driven roller 41.

The number and arrangement of rollers that are provided within the transport path Pc for transporting the sheet S are not limited to those of the configuration illustrated in FIG. 1. Also, the color of the ink used for printing by the processing unit 3 is not limited to the above-described color.

2. Description of UV Irradiator and Sliding Mechanism

Next, the UV irradiator 37*c* and configurations relating to the UV irradiator 37*c* will be described.

Figure 2:
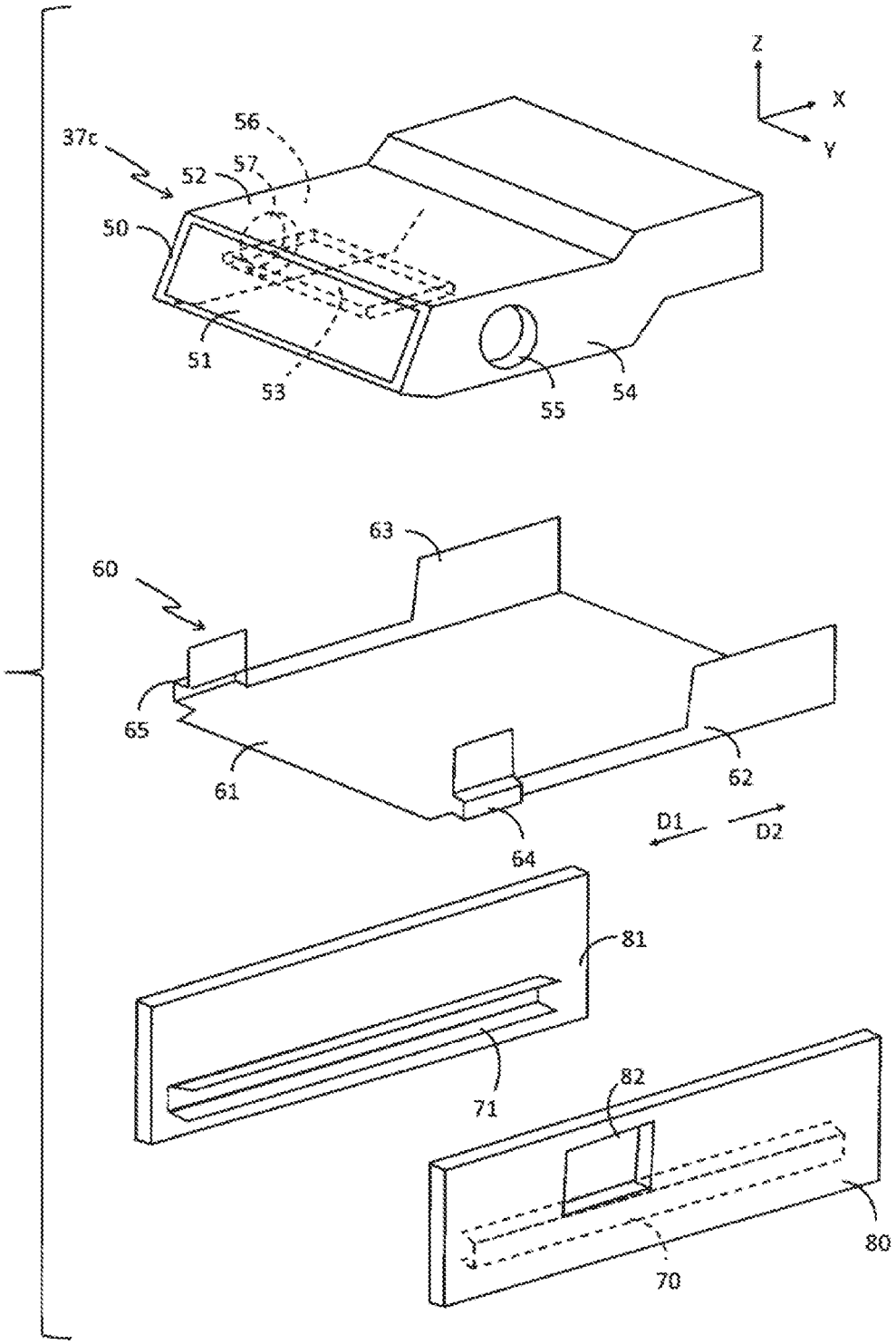
FIG. 2 is an exploded perspective view of an UV irradiator and a sliding mechanism.

FIG. 2 is an exploded perspective view illustrating a configuration of the UV irradiator 37*c* and a slide mechanism that slidably supports the UV irradiator 37*c* as viewed from the front side (the near side in the drawing).

Figure 3:
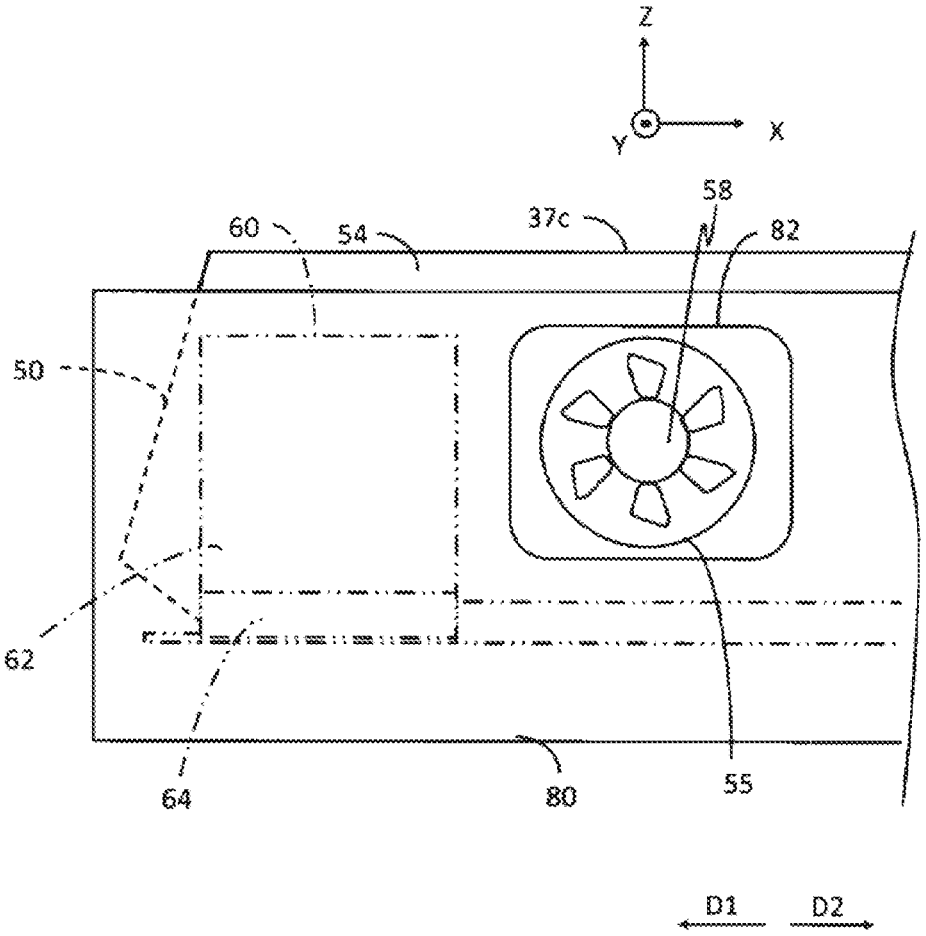
FIG. 3 is a diagram illustrating a positional relationship between the slide mechanism and the UV irradiator located at a first position.

FIG. 3 illustrates a positional relationship between the slide mechanism and the UV irradiator 37*c* located at the first position.

The UV irradiator 37*c* includes an opposing face 50 that faces the rotary drum 30. A light source 51 for applying an ultraviolet ray is provided in the opposing face 50. The light source 51 is an LED, for example. The surface of the UV irradiator 37*c* is covered with the cover 52 in part or in its entirety except for the opposing face 50. In other words, the cover 52 is a housing of the UV irradiator 37*c* that is coupled with the opposing face 50 and is disposed to surround the opposing face 50.

In FIG. 2, some of the configurations inside the cover 52 are indicated by a dashed line. As illustrated in FIG. 2, a circuit board 53 is housed in the cover 52. The circuit board 53 is a substrate for driving the light source 51, and a circuit composed of various types of electronic components required for driving the light source 51 is installed in the circuit board 53. In the UV irradiator 37*c*, each surface of the cover 52 corresponds to a side surface of the opposing face 50. Of the side surfaces, surfaces 54 and 56 that are opposite in the Y direction are referred to as a first surface 54 and a second surface 56. In the example of FIG. 2, the first surface 54 is the front surface of the cover 52, and the second surface 56 is the rear surface of the cover 52.

For the purpose of cooling the circuit board 53 that generates heat in driving of the light source 51, the cover 52 includes a airflow inlet 55 and a airflow outlet 57 as through holes. The airflow inlet 55 is formed in the first surface 54, and the airflow outlet 57 is formed in the second surface 56. Air flowing into the cover 52 from the airflow inlet 55 cools the circuit board 53. Air inside the cover 52 flows out of the cover 52 from the airflow outlet 57. Although the illustration is omitted in FIG. 2, an air intake fan 58 configured to introduce cooling air into the cover 52 is provided in association with the airflow inlet 55, and an exhaust fan 59 configured to eject air out of the cover 52 is provided in association with the airflow outlet 57. See FIGS. 3, 7 and 8 for the intake fan 58 and the exhaust fan 59.

In the following description, the airflow inlet 55 is referred to as "first airflow inlet 55" for distinction from a airflow inlet 82 described below.

The UV irradiator 37*c* is mounted on a movable frame 60. The movable frame 60 is formed by, for example, bend in airflow sheet metal or the like. The movable frame 60 includes a bottom part 61 that supports the UV irradiator 37*c* from below, and a first frame wall 62 and a second frame wall 63 extending upright from the end of the bottom part 61. In the state where the UV irradiator 37*c* is mounted on the movable frame 60, the first frame wall 62 is located forward of the first surface 54 of the cover 52 so as to face the first surface 54. In addition, in the state where the UV irradiator 37*c* is mounted on the movable frame 60, the second frame wall 63 is located rearward of the second face 56 of the cover 52 so as to face the second surface 56.

As illustrated in FIG. 2, the first frame wall 62 includes a protrusion 64 protruding outward, and the second frame wall 63 includes a protrusion 65 protruding outward. More specifically, the protrusion 64 is a portion protruding forward from the first frame wall 62, and the protrusion 65 is a portion protruding rearward from the second frame wall 63. The UV irradiator 37*c* is fixed to the movable frame 60 in the state where the UV irradiator 37*c* is mounted on the movable frame 60 having the above-mentioned configuration.

In FIG. 2, reference signs 70 and 71 represent slide rails elongated in a direction parallel to a first direction D1 and a second direction D2. The first direction D1 is the direction in which the UV irradiator 37*c* approaches the rotary drum 30, and the second direction D2 is the direction opposite to the first direction D1. In the illustrated example, the first direction D1 and the second direction D2 are parallel to the X direction. Note that the first direction D1 and the second direction D2 may be inclined with respect to the X direction.

A slide rail 70 is a rail fixed to a first fixed frame 80 in the state where a recess faces the first frame wall 62 of the movable frame 60. A slide rail 71 is a rail fixed to a second fixed frame 81 in the state where a recess faces the second frame wall 63 of the movable frame 60. In FIG. 2, the slide rail 70 hidden by the first fixed frame 80 is indicated by a dashed line.

FIG. 2 illustrates a portion of the first fixed frame 80 and the second fixed frame 81. The first fixed frame 80 and the second fixed frame 81 are collectively referred to as a fixed frame. The slide rails 70 and 71 may be understood as a part of the fixed frame. The fixed frame is formed of, for example, a sheet metal or the like, and is fixed inside the housing 10 of the printing apparatus 1. More specifically, the first fixed frame 80 is located forward of the first frame wall 62 of the movable frame 60 and faces the first surface 54 and the first frame wall 62. The second fixed frame 81 is located rearward of the second frame wall 63 of the movable frame 60 and faces the second surface 56 and the second frame wall 63. The first fixed frame 80 and the second fixed frame 81 may be members separate from each other or may be partially coupled with each other.

The protrusion 64 of the first frame wall 62 fits into the recess of the slide rail 70, and the protrusion 65 of the second frame wall 63 fits into the recess of the slide rail 71. Thus, the movable frame 60 on which the UV irradiator 37*c* is mounted is allowed to move in the first direction D1 and the second direction D2 while being regulated by the slide rails 70 and 71.

In the following description, movement of the movable frame 60 on which the UV irradiator 37*c* is mounted is simply referred to as movement of the UV irradiator 37*c*. The movement of the UV irradiator 37*c* may be achieved by power of a motor or the like, or may be achieved by hand of a user. When the UV irradiator 37*c* moves in the first direction D1, the opposing face 50 comes close to the rotary drum 30. The position of the UV irradiator 37*c* when the UV irradiator 37*c* comes close to the rotary drum 30 such that the gap between the opposing face 50 and the rotary drum 30 is a predetermined distance is referred to as "first position". The UV irradiator 37*c* illustrated in FIG. 1 may be understood as being located at a first position. In addition, the UV irradiator 37*c* illustrated in FIG. 3 is located also at the first position.

At the first position, the UV irradiator 37*c* drives the light source 51 and emits an ultraviolet ray from the light source 51. The UV irradiator 37*c* does not move beyond the first position in the first direction D1. Although not illustrated in the drawings, a stopper may be provided in the movable frame 60, the slide rails 70 and 71, and the like to prevent the movement of the UV irradiator 37*c* beyond the first position in the first direction D1. By moving the UV irradiator 37*c* located at the first position in the second direction D2, the UV irradiator 37*c* may be separated away from the rotary drum 30. For example, the UV irradiator 37*c* is moved in the second direction D2 for maintenance of the UV irradiator 37*c* and/or for an operation of passing the sheet S through the transport path Pc.

The movable frame 60 including the protrusions 64 and 65 and the fixed frame including the slide rails 70 and 71 constitute a "slide mechanism" that movably supports the circuit unit in the first direction D1, which is a direction toward the support unit and a second direction D2, which is the direction opposite to the first direction D1. Note that the arrangement of the protrusion and the recess constituting the sliding mechanism for supporting the circuit unit as a movable body may be an arrangement opposite to the above-described configuration. Specifically, a configuration corresponding to the slide rail as a recess may be provided in the movable body or the movable frame, and a protrusion that fits into the recess may be provided in the fixed frame.

FIG. 3 illustrates a portion of the first fixed frame 80, and the movable frame 60 and the UV irradiator 37*c* located rearward of the first fixed frame 80 as viewed from the front side. In FIG. 3, the movable frame 60 and UV irradiator 37*c* hidden by the first fixed frame 80 are indicated by a two-dot chain line and a dashed line, respectively. In addition, in FIG. 3, illustration of the slide rail 70 of the first fixed frame 80 is omitted.

The airflow inlet 82 serving airflow a through-hole is formed in the first fixed frame 80. In the following description, the airflow inlet 82 is referred to as "second airflow inlet 82". As shown in FIG. 3, the second airflow inlet 82 is formed in the first fixed frame 80 at a position that faces the first airflow inlet 55 when the UV irradiator 37*c* is located at the first position.

3. Description of Duct

Next, a duct provided in association with the first airflow inlet 55 will be described. The cover 52 of the UV irradiator 37*c* includes a first duct 90 that communicates with the first airflow inlet 55. The fixed frame of the slide mechanism includes a second duct 100 that communicates with the second airflow inlet 82.

Figure 4:
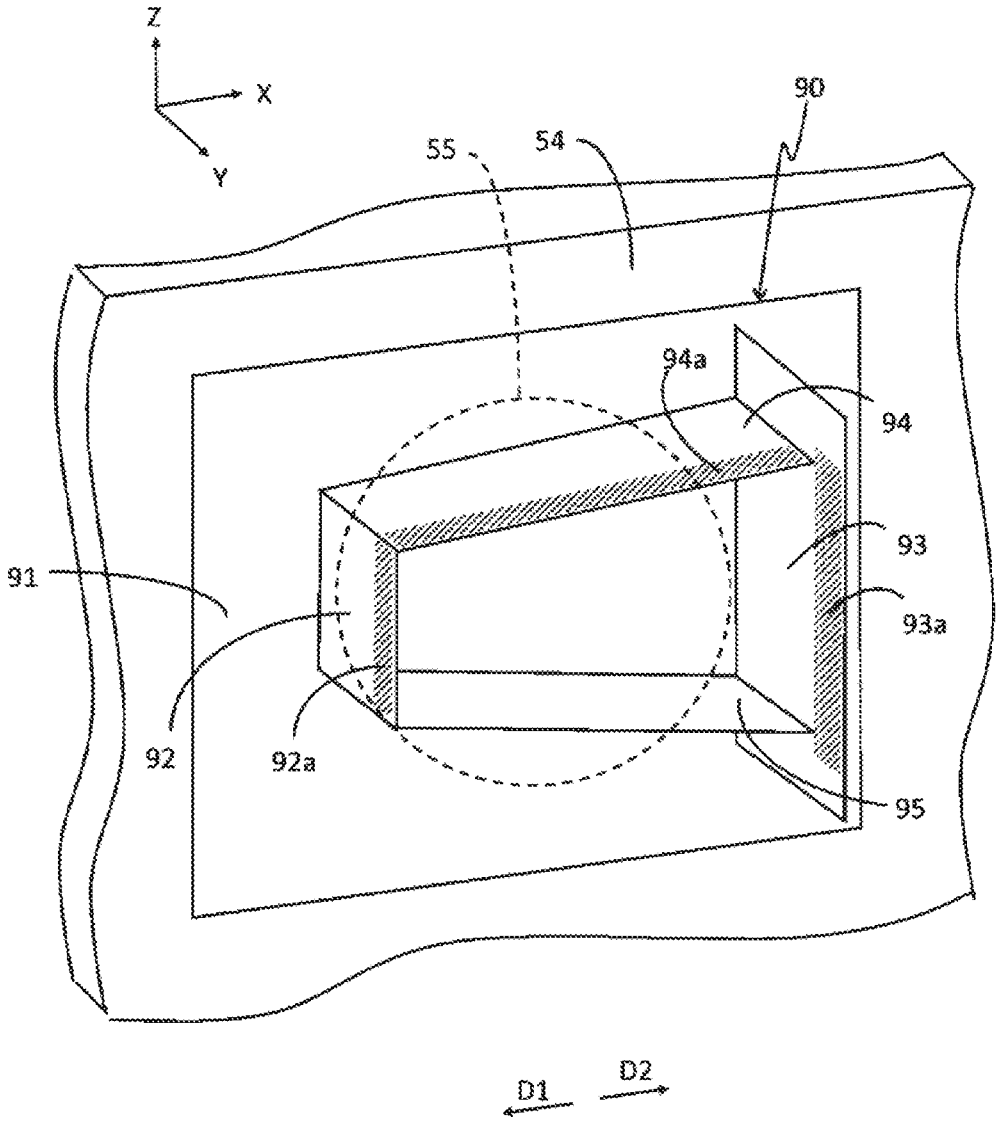
FIG. 4 is a perspective view illustrating a first duct.

FIG. 4 is a perspective view illustrating the first duct 90 as viewed from the front side. The first duct 90 includes a flange 91, and walls 92, 93, 94 and 95 extending upright from the flange 91. The first duct 90 is formed of, for example, a sheet metal or the like. The flange 91 is a surface that is parallel or substantially parallel to the first surface 54 of the cover 52 and is attached to the first surface 54. A hole that communicates with the first airflow inlet 55 is formed in a center portion of the flange 91, and the walls 92, 93, 94 and 95 surround the periphery of the hole. Of the walls 92, 93, 94 and 95, the wall 92 and the wall 93 face each other, and the wall 94 and the wall 95 face each other. The wall 92 is closer to the rotary drum 30 than the wall 93 in the first direction D1. Of the walls 92, 93, 94 and 95, the wall 94 is located on the upper side and the wall 95 is located on the lower side. For convenience sake, the wall 92 is referred to as a first duct left wall 92, the wall 93 as a first duct right wall 93, the wall 94 as a first duct upper wall 94, and the wall 95 as a first duct lower wall 95.

As illustrated in FIG. 4, the first duct right wall 93 has a higher degree of projection from the flange 91, i.e., a greater height from the flange 91, than other walls of the first duct 90, namely, the first duct left wall 92, the first duct upper wall 94, and the first duct lower wall 95. Such a first duct 90 may be a member attached as described above at a position that communicates with the first airflow inlet 55 of the cover 52 of the UV irradiator 37*c*, or may be a portion of the cover 52 that is integrally formed with the cover 52 at a position that communicates with the first airflow inlet 55. Naturally, the first duct 90 is movable together with the UV irradiator 37*c* in the first direction D1 and/or the second direction D2.

Figure 5:
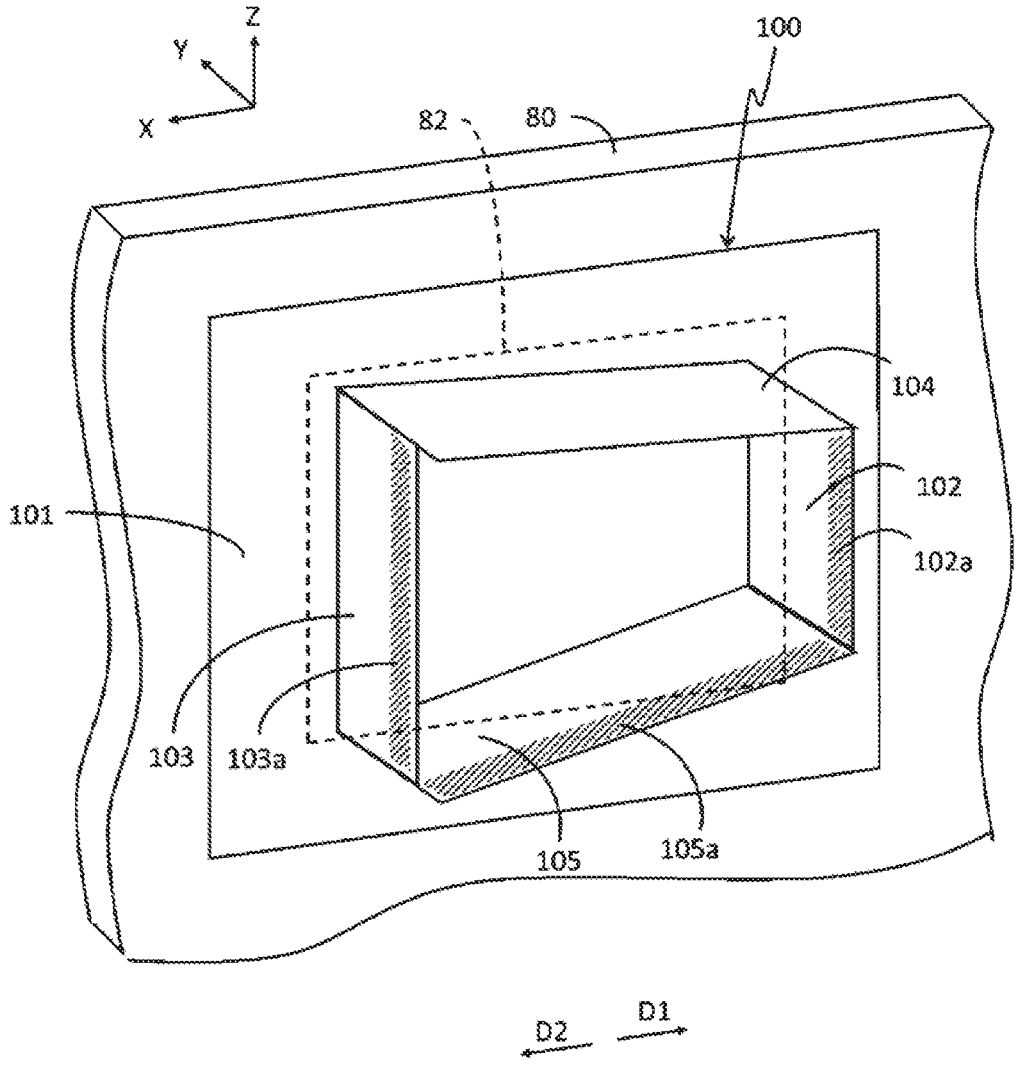
FIG. 5 is a perspective view illustrating airflow second duct.

FIG. 5 is a perspective view illustrating the second duct 100 as viewed from the rear side. The second duct 100 includes a flange 101, and walls 102, 103, 104 and 105 extending upright from the flange 101. The second duct 100 is formed of, for example, a sheet metal or the like. The flange 101 is a surface that is parallel to or substantially parallel to the surface of the first fixed frame 80, and is attached to the surface of the first fixed frame 80 that faces the first surface 54 of the cover 52. A hole that communicates with the second airflow inlet 82 is formed in a center portion of the flange 101, and the walls 102, 103, 104 and 105 surround the periphery of the hole. Of the walls 102, 103, 104 and 105, the wall 102 and the wall 103 face each other, and the wall 104 and the wall 105 face each other. The wall 120 is located closer to the rotary drum 30 than the wall 103 in the first direction D1. Of the walls 102, 103, 104 and 105, the wall 104 is located on the upper side and the wall 105 is located on the lower side. For convenience sake, the wall 102 is referred to as a second duct left wall 102, the wall 103 as a second duct right wall 103, the wall 104 as a second duct upper wall 104, and wall 105 as a second duct lower wall 105.

As illustrated in FIG. 5, the second duct right wall 103 has a lower degree of projection from the flange 101, i.e., a smaller height from the flange 101, than other walls of the second duct 100, namely, the second duct left wall 102, the second duct upper wall 104, and the second duct lower wall 105. Such a second duct 100 may be a member attached as described above at a position that communicates with the second airflow inlet 82 of the first fixed frame 80, or may be a portion of the first fixed frame 80 that is integrally formed with the first fixed frame 80 at a position that communicates with the second airflow inlet 82.

Figure 6A:
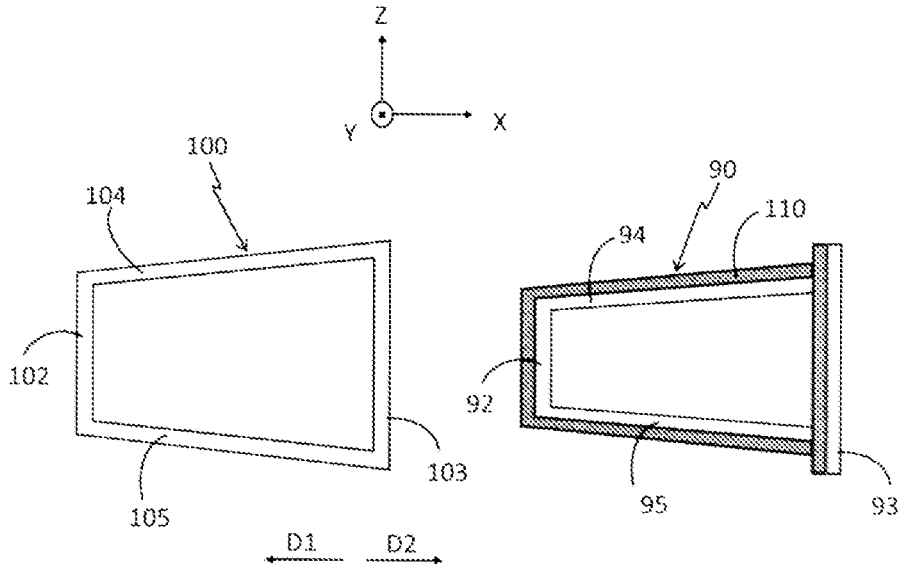
FIG. 6A is a diagram illustrating the first duct and the second duct in the state where the UV irradiator is not located at the first position.
Figure 6B:
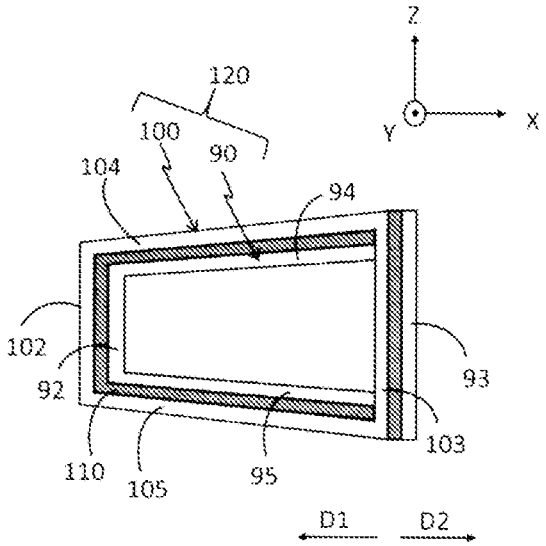
FIG. 6B is a diagram illustrating the first duct and the second duct in the state where the UV irradiator is located at the first position.

FIGS. 6A and 6B illustrate shapes of the first duct 90 and the second duct 100 as viewed from the front side. Note that FIG. 6A illustrates a state where the UV irradiator 37*c* is located at a remote position than the first position in the second direction D2, and FIG. 6B illustrates a state where the UV irradiator 37*c* is located at the first position. In FIGS. 6A and 6B, the first duct left wall 92, the first duct right wall 93, the first duct upper wall 94 and the first duct lower wall 95 of the first duct 90, and the second duct left wall 102, the second duct right wall 103, the second duct upper wall 104 and the second duct lower wall 105 of the second duct 100 are provided with certain thicknesses for illustration. In addition, in FIGS. 6A and 6B, illustration of the flange 91 of the first duct 90 and the flange 101 of the second duct 100 is omitted.

As illustrated in FIG. 6A, in the state where the UV irradiator 37*c* is not located at the first position, the first duct 90 and the second duct 100 are not in communication with each other. As illustrated in FIG. 6B, the first duct 90 and the second duct 100 communicate with each other when the UV irradiator 37*c* moves in the first direction D1 from the state illustrated in FIG. 6A and reaches the first position. Specifically, as the UV irradiator 37*c* moves in the first direction D1, a portion of the first duct 90 is housed inside the second duct 100, and thus the first duct 90 and the second duct 100 are engaged with each other. The term "engage" means fitting each other, which includes, for example, coupling, overlapping, and contacting.

In the first duct 90 illustrated in FIG. 4, the hatched portion is a "first engagement part" that engages with the second duct 100 of the first duct 90. In other words, a tip end portion 92*a* of the outer surface of the first duct left wall 92, a tip end portion 93*a* of the inner surface of the first duct right wall 93, and a tip end portion 94*a* of the outer surface of the first duct upper wall 94 correspond to the first engagement part. In addition, although not illustrated in FIG. 4, the tip end portion of the outer surface of the first duct lower wall 95 also corresponds to the first engagement part.

In the second duct 100 illustrated in FIG. 5, the hatched portion is a "second engagement part" that engages with the first duct 90 of the second duct 100. In other words, a tip end portion 102*a* of the inner surface of the second duct left wall 102, a tip end portion 103*a* of the outer surface of the second duct right wall 103, and a tip end portion 105*a* of the inner surface of the second duct lower wall 105 correspond to the second engagement part. In addition, although not illustrated in FIG. 5, the tip end portion of the inner surface of the second duct upper wall 104 also corresponds to the second engagement part.

The state where the tip end portion 92*a* of the outer surface of the first duct left wall 92 overlaps the tip end portion 102*a* of the inner surface of the second duct left wall 102, the tip end portion 94*a* of the outer surface of the first duct upper wall 94 overlaps the tip end portion of the inner surface of the second duct upper wall 104, and the tip end portion of the outer surface of the first duct lower wall 95 overlaps the tip end portion 105*a* of the inner surface of the second duct lower wall 105 is the state where a portion of the first duct 90 is housed inside the second duct 100. The first duct 90 is formed in such a size that a portion of the first duct 90 is housed inside the second duct 100.

As described above, in the second duct 100, the second duct right wall 103 has a lower height from the flange 101 than the second duct left wall 102, the second duct upper wall 104, and the second duct lower wall 105. As such, when the UV irradiator 37*c* moves in the first direction D1, the first duct 90 is partially housed inside the second duct 100 without hitting the second duct right wall 103 at the first duct left wall 92. In addition, as described above, in the first duct 90, the first duct right wall 93 has a higher height from the flange 91 than the first duct left wall 92, the first duct upper wall 94, and the first duct lower wall 95. Thus, in the state where a portion of the first duct 90 is housed inside the second duct 100, the tip end portion 93*a* of the inner surface of the first duct right wall 93 overlaps the tip end portion 103*a* of the outer surface of the second duct right wall 103.

When the first duct 90 and the second duct 100 engage with each other in the above-described manner, the first airflow inlet 55 and the second airflow inlet 82 communicate with each other. The first duct 90 and the second duct 100 in the state where the first airflow inlet 55 and the second airflow inlet 82 are in communication with each other are collectively referred to as a third duct 120.

As illustrated in FIGS. 4, 5, 6A and 6B, the shape of the opening of the first duct 90 and the shape of the opening of the second duct 100 are shapes tapered toward the first direction D1. Thus, with the tapered shapes of the openings of the first duct 90 and the second duct 100, a portion of the first duct 90 can be smoothly housed inside the second duct 100 as the UV irradiator 37*c* moves in the first direction D1.

It is also possible to adopt a configuration including a cushioning member at least at one of the first engagement part of the first duct 90 and the second engagement part of the second duct 100. In FIGS. 6A and 6B, the grey colored member is a sponge 110 as an example of a cushioning member. In the example of FIGS. 6A and 6B, the sponge 110 is bonded to the first engagement part of the first duct 90. Thus, as illustrated in FIG. 6B, when the first duct 90 and the second duct 100 are engaged with each other, the sponge 110 is interposed between the first duct 90 and the second duct 100. Naturally, the sponge 110 may be bonded to the second engagement part of the second duct 100. The sponge 110 fill a gap between the first duct 90 and the second duct 100 forming the third duct 120. In addition, when a portion of the first duct 90 is housed inside the second duct 100 as the UV irradiator 37*c* moves in the first direction D1, the sponge 110 eases the impact exerted on the first duct 90 and the second duct 100.

Figure 7:
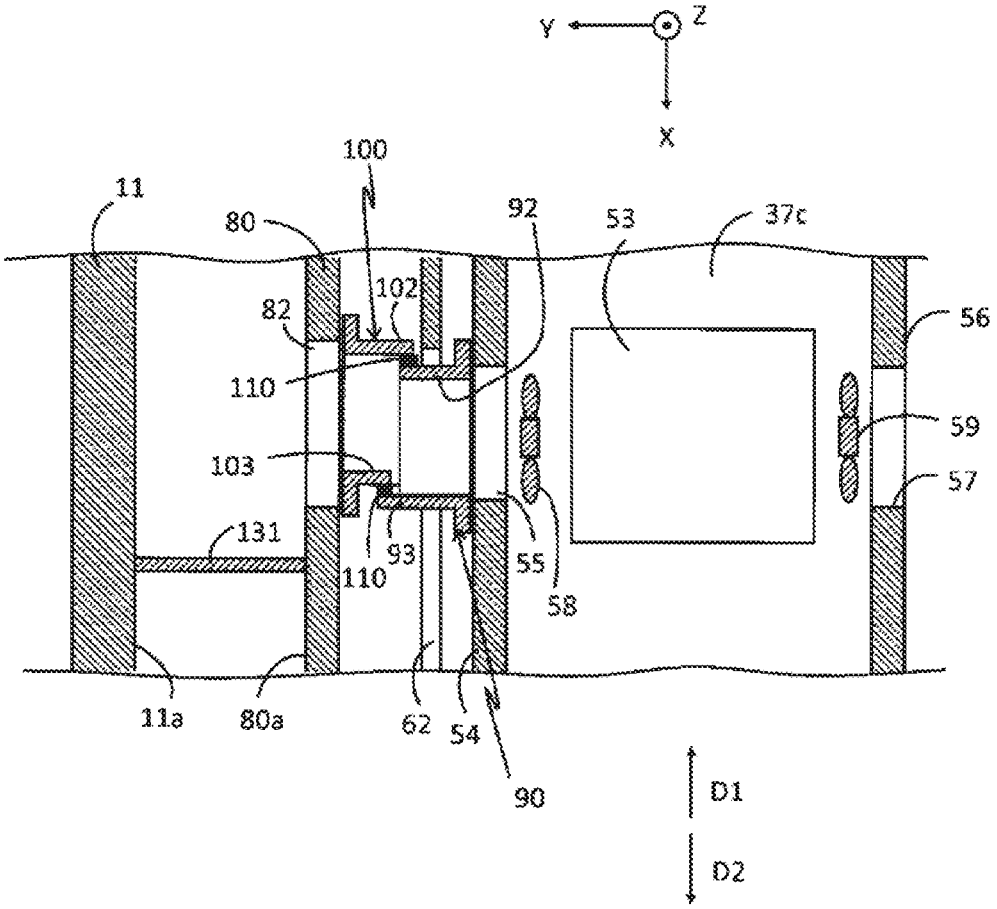
FIG. 7 is a cross-sectional view of a partial range including the UV irradiator.

FIG. 7 is a cross-sectional view, through the first airflow inlet 55 and the second airflow inlet 82, of a partial range including the UV irradiator 37*c* of the printing apparatus 1 as viewed from above. In FIG. 7, the cross section of each member is hatched except for of the cross section of the sponge 110. Note that, while the convex portion 64 and the slide rail 70 are present between the first frame wall 62 of the movable frame 60 and the first fixed frame 80 of the fixed frame, illustration of the protrusion 64 and the slide rail 70 is omitted in FIG. 7.

FIG. 7 illustrates a state where the UV irradiator 37*c* is located at the first position. In other words, the first duct 90 and the second duct 100 illustrated in FIG. 7 form the third duct 120 and communicate between the first airflow inlet 55 and the second airflow inlet 82. According to FIG. 7, the first duct 90 and the second duct 100 are engaged with each other at a position between the first frame wall 62 and the first fixed frame 80 in the Y direction. In addition, according to FIG. 7, a portion of the first duct 90 is housed inside the second duct 100.

When the third duct 120 is formed and the first airflow inlet 55 and the second airflow inlet 82 communicate with each other, air outside the first fixed frame 80 whose amount of floating mist is very small flows into the cover 52 through the third duct 120 and the first airflow inlet 55 from the second airflow inlet 82. Then, the third duct 120 can prevent inflow of mist floating in the printing apparatus 1 into the first airflow inlet 55 from the gap between the first fixed frame 80 and the first frame wall 62 of the movable frame 60 and/or the gap between the first frame wall 62 and the first surface 54 of the cover 52.

With reference to FIGS. 6A and 6B, the sponge 110 between the first duct left wall 92 of the first duct 90 and the second duct left wall 102 of the second duct 100 illustrated in FIG. 7 is the sponge 110 bonded to the first duct left wall 92. In addition, with reference to FIGS. 6A and 6B, the sponge 110 between the first duct right wall 93 of the first duct 90 and the second duct right wall 103 of the second duct 100 illustrated in FIG. 7 is the sponge 110 bonded to the first duct right wall 93.

Figure 8:
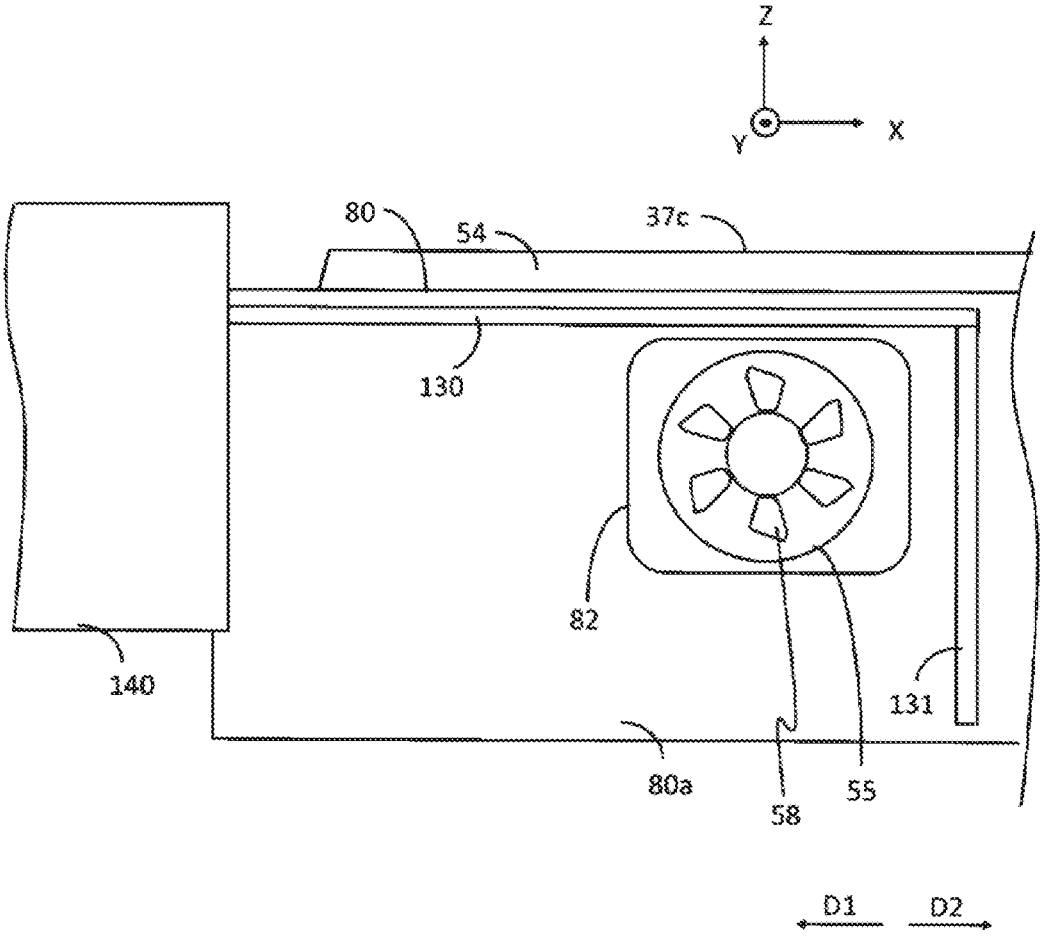
FIG. 8 is a diagram illustrating airflow rate where a wall part is provided on an outer side of the sliding mechanism.

FIG. 8 illustrates a configuration of a region around the first fixed frame 80 serving airflow the sliding mechanism as viewed from the same direction as FIG. 3. As illustrated in FIG. 8, the present embodiment may have a configuration in which wall parts 130 and 131 extending upright from an outer surface 80*a* of the first fixed frame 80 close at least a portion of the periphery of the second airflow inlet 82. The wall parts 130 and 131 are plate-like members. The outer surface 80*a* is a surface of the first fixed frame 80, and is a rear surface of a surface that faces the first surface 54 of the surface of the cover 52. The surface of the first fixed frame 80 that faces the first surface 54 of the cover 52 may be referred to as an inner surface of the first fixed frame 80. The second duct 100 protrudes from the inner surface of the first fixed frame 80 toward the cover 52.

In the example illustrated in FIG. 8, a drum cooling device 140 for cooling the rotary drum 30 is disposed at a predetermined position that is closer to the rotary drum 30 than the second airflow inlet 82 in the first direction D1. In such a configuration, the wall part 130 is disposed at a position above the second airflow inlet 82 in such a manner that the end facing toward the first direction D1 reaches the drum cooling device 140. In addition, the wall part 131 is disposed at a predetermined position farther from the rotary drum 30 than the second airflow inlet 82 in the second direction D2 in such a manner that the wall part 131 extends downward and is in contact with the end of the wall part 130 facing toward the second direction D2.

The tip ends of the wall parts 130 and 131 extending upright from the outer surface 80*a* of the first fixed frame 80 are in contact with an inner surface 11*a* of the housing 10 of the printing apparatus 1, for example. FIG. 7 illustrates a state where the tip end of the wall part 131 is in contact with the inner surface 11*a* of the front wall 11 of the housing 10. Although the wall part 130 is not illustrated in FIG. 7, the tip end of wall part 130 is also in contact with the inner surface 11*a* of front wall 11 as with the tip end of wall part 131. The tip ends of the wall parts 130 and 131 may be a cushioning member, such as the sponge 110 described above, and may be configured such that the cushioning member makes contact with the inner surface 11*a* of the front wall 11. Such wall parts 130 and 131 can reduce inflow, into the second airflow inlet 82, of mist generated from the print head 6.

4. Summary

As described above, according to the present embodiment, the printing apparatus 1 includes a support unit configured to support a printing medium, the print head 6 disposed at a position opposite the support unit, the print head 6 being configured to eject liquid to the printing medium, the circuit unit disposed downstream of the print head 6 in the transport path Pc of the printing medium at a position opposite the support unit, and the sliding mechanism configured to support the circuit unit such that the circuit unit is movable in the first direction D1 in which the circuit unit approaches the support unit and the second direction D2 that is opposite the first direction D1. The circuit unit includes the circuit board 53, the cover 52 surrounding the opposing face 50 is opposite the support unit, the cover 52 being configured to house the circuit board 53 inside the cover 52, the first airflow inlet 55 formed in the first surface 54 of the cover 52, and the first duct 90 formed in the first surface 54 in communication with the first airflow inlet 55. The sliding mechanism includes the fixed frame fixed inside the printing apparatus 1 and configured to support the circuit unit, the second airflow inlet 82 formed in the fixed frame, the second airflow inlet 82 being formed at a position that is opposite the first airflow inlet 55 when the circuit unit is located at a first position where the circuit unit is close to the support unit, and the second duct 100 formed in the fixed frame and in communication with the second airflow inlet 82. When the circuit unit is located at the first position, the first duct 90 and the second duct 100 are engaged with each other such that the third duct 120 is formed, the third duct 120 being configured to communicate between the first airflow inlet 55 and the second airflow inlet 82.

With the above-described configuration, when the circuit unit is moved to the first position, the first duct 90 and the second duct 100 engage with each other and form the third duct 120 that connects between the first airflow inlet 55 and the second airflow inlet 82. With the third duct 120 thus formed, it is possible to reduce inflow, into the cover 52 from the first airflow inlet 55, mist that is generated through ejection of liquid by the print head 6 in the printing apparatus 1. By reducing the inflow of the mist into the cover 52, attachment of the mist to the circuit board 53 can be reduced and the circuit board 53 can be protected.

In addition, in the present embodiment, the first duct 90 and the second duct 100 may engage with each other when a portion of the first duct 90 is housed inside the second duct 100.

With the above-described configuration, it is possible to form the third duct 120, with which mist does not easily pass through the connecting portions between the first duct 90 and the second duct 100.

In addition, in the present embodiment, the shape of the opening of the first duct 90 and the shape of the opening of the second duct 100 may be tapered toward the first direction D1.

With the above-described configuration, when the circuit unit moves in the first direction D1, a portion of the first duct 90 can be smoothly housed inside the second duct 100.

Note that the configuration in which a portion of the first duct 90 is housed inside the second duct 100 is merely an example. For example, a configuration may be adopted in which the opening size of the first duct 90 is greater than the opening size of the second duct 100, and a portion of the second duct 100 is housed inside the first duct 90. In addition, in the case where a portion of the second duct 100 is housed inside the first duct 90, the shape of the opening of the first duct 90 and the shape of the opening of the second duct 100 may be tapered toward the second direction D2.

In addition, in the present embodiment, a cushioning member may be provided at least at one of the first engagement part of the first duct 90 and the second engagement part of the second duct 100, the first engagement part being configured to engage with the second duct 100, the second engagement part being configured to engage with the first duct 90.

With the above-described configuration, the gap between the first duct 90 and the second duct 100 is filled with the cushioning member, and it is thus possible to more reliably prevent the entry of mist from the connecting portions between the first duct 90 and the second duct 100. Additionally, when the first duct 90 and the second duct 100 engage with each other, the cushioning member can ease the impact exerted on the first duct 90 and the second duct 100.

In addition, in the present embodiment, the wall parts 130 and 131, which close at least a part of the periphery of the second airflow inlet 82, may extend upright from the back surface (the outer surface 80*a*) of the surface of the fixed frame that faces the first surface 54.

With the above-described configuration, the inflow of mist into the cover 52 through the second airflow inlet 82 can be reduced.

In addition, in the present embodiment, the tip ends of the wall parts 130 and 131 may be in contact with the inner surface 11*a* of the housing 10 of the printing apparatus 1.

With the above-described configuration, the inflow of mist into the cover 52 through the second airflow inlet 82 can be more sufficiently reduced.

In addition, in the present embodiment, the circuit unit may be an irradiator configured to emit, at the first position, an ultraviolet ray from the opposing face 50 to the printing medium on which the liquid was ejected by the print head 6.

With to the above-described configuration, the circuit board 53 inside the cover 52 can be protected from the mist for the UV irradiator 37*c* that is located at a position downstream of the print head 6, i.e., a position where the mist generated by the print head 6 is easily received from the airflow inlet, and is movable in the first direction D1 and the second direction D2.

Referring to FIG. 1, the UV irradiator 37*c* that is the most downstream UV irradiator 37, i.e., the first irradiator, is relatively far from the adjacent print head 6 along the transport path Pc and has a wider space in comparison with the UV irradiators 37*a* and 37*b*, which are the second irradiators. As such, a larger amount of mist is likely to float and remain in the region near the UV irradiator 37*c*, and the UV irradiator 37*c* entails a higher risk of failure of the circuit board due to the influence of mist in comparison with other UV irradiators 37. That is, in the printing apparatus 1, a first irradiator, a second irradiator that is an irradiator different from the first irradiator, a first print head that is the print head 6, and a second print head that is the print head 6 different from the first print head are disposed along the transport path Pc, and the distance between the first irradiator and the print head 6 adjacent to the first irradiator is greater than the distance between the second irradiator and the print head 6 adjacent to the second irradiator. In the present embodiment, regarding the first irradiator disposed in the above-described manner, the circuit board inside the first irradiator is protected from the mist by applying the features in which the third duct 120 is formed by the first duct 90 and the second duct 100. Note that each of the first print head and the second print head does not represent a specific print head 6, and the first print head and the second print head merely mean the presence of a plurality of print heads 6. When any one of the plurality of print heads 6 is referred to as the first print head, the print head 6 different from the one print head 6 corresponds to the second print head.

5. Description for Other Points

The present embodiment is not limited to the configuration including a plurality of the print heads 6 and a plurality of the UV irradiators 37. For example, the present embodiment is applicable to the printing apparatus 1 including one print head 6 and one UV irradiator 37 that is disposed downstream of the print head 6.

The circuit unit that cools the circuit board housed inside the cover with an external air flow while protecting it from mist is not limited to the UV irradiator 37. For example, on the assumption that a plurality of the print heads 6 are present and that one print head 6 is disposed downstream of another print head 6, the present embodiment is applicable to the one print head 6 as the circuit unit.

The support unit that supports the printing medium is not limited to the rotary drum 30. For example, the support unit may have a configuration in which a flat supporting surface is provided and a process such as printing is performed on a printing medium supported by the flat supporting surface.

Naturally, the positional relationship of the components in the present embodiment is not limited to the illustrated configuration. For example, the positional relationship between the feeding unit 2 and the winding unit 4 sandwiching the processing unit 3 may be opposite to the positional relationship illustrated in FIG. 1. In addition, various modifications may be made to the positional relationship between the airflow outlet and the airflow inlet in the cover of the circuit unit. For example, the positional relationship between the airflow outlet 57 and the first airflow inlet 55 in the cover 52 may be opposite to the positional relationship illustrated in FIGS. 2 and 7. In this case, the third duct 120 and the second airflow inlet 82 of the fixed frame are formed on the rear side of the cover 52.

What is claimed is:

1. A printing apparatus comprising:

a support unit configured to support a printing medium;

a print head disposed at a position opposite the support unit, the print head being configured to eject liquid to the printing medium;

a circuit unit disposed at a position opposite the support unit and downstream of the print head in a transport path of the printing medium; and a sliding mechanism configured to support the circuit unit such that the circuit unit is movable in a first direction approaching the support unit and a second direction that is opposite the first direction; wherein the circuit unit includes a circuit board;

a cover surrounding an opposing face that is opposite the support unit, the cover being configured to house the circuit board inside the cover;

a first airflow inlet formed in a first surface of the cover; and a first duct formed in the first surface, the first duct being in communication with the first airflow inlet;

the sliding mechanism includes a fixed frame fixed inside the printing apparatus and configured to support the circuit unit;

a second airflow inlet formed in the fixed frame, the second airflow inlet being formed at a position that is opposite the first airflow inlet when the circuit unit is located at a first position where the circuit unit is close to the support unit; and a second duct that is formed in the fixed frame and in communication with the second airflow inlet; and when the circuit unit is located at the first position, the first duct and the second duct are engaged with each other such that a third duct is formed to cause the first airflow inlet and the second airflow inlet to communicate with each other.

2. The printing apparatus according to claim 1, wherein a portion of the first duct is housed inside the second duct such that the first duct and the second duct engage with each other.

3. The printing apparatus according to claim 2, wherein a shape of an opening of the first duct and a shape of an opening of the second duct are tapered toward the first direction.

4. The printing apparatus according to claim 1, comprising a cushioning member at least at one of a first engagement part of the first duct and a second engagement part of the second duct, the first engagement part being configured to engage with the second duct, the second engagement part being configured to engage with the first duct.

5. The printing apparatus according to claim 1, wherein the circuit unit is an irradiator configured to emit, at the first position, an ultraviolet ray from the opposing face to the printing medium on which the liquid was ejected by the print head.

6. The printing apparatus according to claim 5, wherein a first irradiator that is the irradiator, a second irradiator that is an ultraviolet irradiator different from the first irradiator, a first print head that is the print head, and a second print head that is a print head different from the first print head are disposed along the transport path; and a distance between the first irradiator and the print head adjacent to the first irradiator is greater than a distance between the second irradiator and the print head adjacent to the second irradiator.

7. The printing apparatus according to claim 1, wherein a wall part extending upright from an opposite surface of the fixed frame from a surface facing the first surface, the wall part being configured to close at least a portion of a periphery of the second airflow inlet.

8. The printing apparatus according to claim 7, wherein a tip end of the wall part is in contact with an inner surface of a housing of the printing apparatus.

* * * * *